US011156239B2

(12) United States Patent
Geiger et al.

(10) Patent No.: US 11,156,239 B2
(45) Date of Patent: Oct. 26, 2021

(54) HYDRAULIC PRESSURIZING MEDIUM SUPPLY ASSEMBLY, METHOD, AND MOBILE WORK MACHINE

(71) Applicant: Robert Bosch GmbH, Stuttgart (DE)

(72) Inventors: Daniel Geiger, Ulm (DE); Florian Muehlbauer, Neu-Ulm (DE); Marcel Golde, Laupheim (DE); Michael Brand, Ulm (DE); Minha An, Weissenhorn (DE); Salih Tetik, Nersingen (DE); Ximing Wang, Neu-Ulm (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/938,390

(22) Filed: Jul. 24, 2020

(65) Prior Publication Data

US 2021/0025414 A1 Jan. 28, 2021

(30) Foreign Application Priority Data

Jul. 26, 2019 (DE) ..... 10 2019 120 333.3
Dec. 10, 2019 (DE) ..... 10 2019 219 206.8

(51) Int. Cl.
*F15B 21/08* (2006.01)
*E02F 9/22* (2006.01)
*F15B 11/16* (2006.01)

(52) U.S. Cl.
CPC ..... *F15B 21/082* (2013.01); *E02F 9/2228* (2013.01); *F15B 11/16* (2013.01);
(Continued)

(58) Field of Classification Search
CPC ..... E02F 9/2228; F15B 21/085
See application file for complete search history.

(56) References Cited

U.S. PATENT DOCUMENTS 4,510,750 A 4/1985 Izumi et al.
4,811,561 A * 3/1989 Edwards ..... G05B 19/414 340/3.1

(Continued)

FOREIGN PATENT DOCUMENTS

DE 69132869 T2 4/2002
DE 10 2010 020 004 A1 9/2011

(Continued)

OTHER PUBLICATIONS

Bosch Rexroth AG, "Pressure and flow control system," Data Sheet RE 30630/04.13, 2013 (English language equivalent to RD 30630/04.13) (28 pages).

(Continued)

*Primary Examiner* — Thomas E Lazo
(74) *Attorney, Agent, or Firm* — Maginot, Moore & Beck LLP

(57) ABSTRACT

A hydraulic pressurizing medium supply assembly having a hydro machine for supplying pressurizing medium of at least one hydraulic consumer, includes a hydraulic control block for controlling the at least one consumer, a first control module, and a second control module. The control block, by way of the first control module, is able to be controlled by at least one actuating signal. A data interface is included between the control modules. The first control module, by way of the data interface, as a further actuating signal transfers to the second control module as input variable/variables a nominal outlet pressure for the hydro machine and/or a nominal delivery volume for the hydro machine. The second control module by way of the nominal outlet pressure and/or by way of the nominal delivery volume controls an adjusting mechanism of the hydro machine by way of a valve actuating signal.

10 Claims, 5 Drawing Sheets

(52) U.S. Cl.
CPC ..... *F15B 21/085* (2013.01); *E02F 9/2296* (2013.01); *F15B 2211/25* (2013.01); *F15B 2211/6309* (2013.01); *F15B 2211/6343* (2013.01); *F15B 2211/6652* (2013.01)

(56) References Cited

U.S. PATENT DOCUMENTS

| | | | | |
|---|---|---|---|---|
| 5,170,625 | A | 12/1992 | Watanabe et al. | |
| 5,267,440 | A * | 12/1993 | Nakamura | E02F 9/2235 60/426 |
| 5,267,441 | A | 12/1993 | Devier et al. | |
| 5,947,695 | A * | 9/1999 | Nagaoka | F04B 49/03 417/213 |
| 5,967,756 | A | 10/1999 | Devier et al. | |
| 7,832,208 | B2 * | 11/2010 | Peterson | E02F 9/2292 60/431 |
| 2015/0075148 | A1 * | 3/2015 | Yamaji | F15B 13/06 60/420 |

FOREIGN PATENT DOCUMENTS

| | | | |
|---|---|---|---|
| DE | 102017213118 | A1 | 12/2018 |
| EP | 0 349 092 | B1 | 1/1990 |
| EP | 1 460 505 | A2 | 9/2004 |
| EP | 2 851 565 | A1 | 3/2015 |
| EP | 2 851 565 | B1 | 1/2017 |
| JP | 4801247 | B2 | 10/2011 |
| JP | 5182908 | B2 | 4/2013 |

OTHER PUBLICATIONS

Bosch Rexroth AG, "External control electronics for the SYDEF1 adjustment of the A10VSO axial piston pump," Data Sheet RE 30242/03.10, 2010 (English language equivalent to RD 30242/03.10) (12 pages).

Bosch Rexroth AG, "Electro-hydraulic Control system DFE1," Data Sheet RE 92088/08.04, 2004 (English language equivalent to RD 92088/08.04) (12 pages).

* cited by examiner

HYDRAULIC PRESSURIZING MEDIUM SUPPLY ASSEMBLY, METHOD, AND MOBILE WORK MACHINE

This application claims priority under 35 U.S.C. § 119 to (i) patent application no. DE 10 2019 120 333.3, filed on Jul. 26, 2019 in Germany, and (ii) patent application no. DE 10 2019 219 206.8, filed on Dec. 10, 2019 in Germany. The disclosures of the above-identified patent applications are both incorporated herein by reference in their entirety.

The disclosure relates to a hydraulic pressurizing medium supply assembly for an open hydraulic circuit, for example for mobile work machines.

BACKGROUND

A pressure and flow control system is known from document RD 30630/04.13 of the Rexroth company. Said pressure and flow control system serves for the electro-hydraulic control of swivel angle, pressure and power of an axial piston variable-displacement pump. The control system has an axial piston variable-displacement pump with an electrically actuated proportional valve. A set piston can be actuated by way of said proportional valve. Said set piston serves for adjusting a swash plate of the variable-displacement pump. A displacement transducer by way of which a swivel angle of the swash plate can be determined by way of the displacement path of the set piston is provided for the set piston. As an alternative to the displacement transducer, a swivel angle of the swash plate can also be detected on the pivot axle by way of a Hall sensor. The volumetric flow of the variable-displacement pump can in turn be ascertained from the swivel angle of the swash plate. The variable-displacement pump is driven by a motor. When the variable-displacement pump is not being driven and pressure is absent in the actuating system, the variable-displacement pump, on account of a spring force of a spring, pivots toward a maximum delivery volume. In contrast, the variable-displacement pump in the driven state of the variable-displacement pump and with a non-energized pilot valve and a closed pump outlet pivots toward a zero-stroke pressure. An equilibrium between the pump pressure at the set piston and the spring force of the spring is established at approximately 4 to 8 bar. The initial position is usually assumed when the control electronics are de-energized. A control system for the pilot valve as an input variable has a nominal pressure, a nominal swivel angle, and optionally a nominal output value. An actual pressure at the outlet side of the variable-displacement pump is detected by a pressure sensor. As has been explained above, an actual swivel angle is ascertained by way of the displacement transducer. The recorded actual values are digitally processed in an electronics unit and compared with the predefined nominal values. A minimum value generator then automatically ensures that only the controller assigned to the desired operating point is active. An output signal of the minimum value generator in this instance is a nominal value for a proportional solenoid on the pilot valve. A displacement path of a valve slide of the pilot valve is detected by way of a displacement transducer and relayed to the control system in order for the pilot valve to be controlled. External control electronics are disclosed for the described adjustment of the axial piston variable-displacement machine in document RD 30242/03.10 of the Rexroth company. An electro-hydraulic control system is furthermore disclosed in document RD 92 088/08.04 of the Rexroth company.

A control system for alternatingly controlling a pressure and a conveyed flow is disclosed in EP 1 460 505 A2. A pivotable hydraulic axial piston variable-displacement machine which by way of a drive shaft is connected to a further hydro machine is provided here. A closed-loop control circuit for a drive torque of the variable-displacement machine is furthermore provided. The closed-100p control circuit is supplied an actual drive torque and a nominal drive torque from which a control variable for an actuating installation of the variable-displacement machine is determined. The nominal drive torque in turn is an output variable of a minimum value generator. The latter herein selects an output variable of a pressure controller and of a volumetric flow controller. The volumetric flow of the hydro machine connected to the variable-displacement machine is provided as actual volumetric flow herein. A high pressure of this hydro machine is furthermore provided as the actual pressure.

A hydro machine with a swivel angle sensor and a pressure sensor is furthermore disclosed in each of documents EP 2 851 565 B1, JP 4 801 247, JP 5 182 908, EP 0 349 092 B1, U.S. Pat. Nos. 5,267,441, 5,967,756 and 5,170,625. The pressure, the volumetric flow, and the output can be controlled.

Moreover, load pressure-independent flow distribution (LUDV) systems are known from the prior art. A LUDV system or a LUDV control is a special type of load-sensing (LS) control in which the highest load pressure is reported to a variable-displacement pump and the latter is controlled in such a manner that in the pump line a pump pressure which is above the load pressure by a specific pressure differential $\delta p$ prevails. Individual pressure compensators are assigned to adjustable supply metering orifices of an LS control, said individual pressure compensators also maintaining a constant pressure differential over the supply metering orifices of the hydraulic consumers having a lower load pressure at any given time. In a control assembly usually referred to as a LS control, the individual pressure compensators are disposed upstream of the supply metering orifices and restrict the fluid flow between the pump line and the supply metering orifices to such a degree that the pressure ahead of the supply metering orifices, independently of the pump pressure, is above the individual load pressure only by a specific pressure differential. In the event of a supply deficit the consumer with the highest load pressure slows down because the pump pressure prevalent ahead of the supply metering orifice of the latter drops and the pressure differential over the supply metering orifice of said consumer with the highest load pressure decreases. In the LUDV control the individual pressure compensators are arranged downstream of the supply metering orifices and restrict the fluid flow between the supply metering orifices and the load to such a degree that the pressure downstream of all supply metering orifices is equal, preferably equal to or slightly in excess of the highest load pressure. Here nothing changes in the event of a supply deficit on the pressure downstream of the supply metering orifices. The pump pressure is present in the same way upstream of all supply metering orifices, so that the pressure differential varies in the same way at all supply metering orifices if the pump pressure diminishes in the event of a supply deficit, and the flow distribution between the supply metering orifices is maintained.

In the control described, controlling of the variable-displacement pump takes place by way of a hydro-mechanical pump regulator (differential pressure regulating (DFR)). The pressure differential $\delta p$, or the differential pressure, is pre-set by way of a pre-load of a spring on the pump regulator. As soon as the pump pressure is below the set differential pressure a control edge on a valve slide on the pump regulator is opened in such a manner that the swept volume of the variable-displacement pump is increased. When the differential pressure is attained the pump regulator reaches the regulated position thereof such that a swept volume of the variable-displacement pump is kept in a stationary state. If the pump pressure is higher than the set differential pressure, the swept volume of the variable-displacement pump is correspondingly decreased until a nominal pump pressure is attained. An adjustable differential pressure may be enabled in that an electro-hydraulic pump regulator is used.

In addition to the function of differential pressure regulating it may be necessary for the variable-displacement pump to be limited in terms of the output of the latter, since a maximum output of the variable-displacement pump is typically higher than an available drive output of a drive unit such as, for example, an electric motor or an internal combustion engine such as, for example, a diesel engine. This is usually achieved by an additional component. A superimposed electronic or mechanical closed-loop control circuit limits a swivel angle or a swept volume of the variable-displacement pump as a function of the pressure level such that a maximum torque is not exceeded, or an output remains constant, respectively. This is disclosed in DE 10 2010 020 004, for example.

A dynamic behavior of the system described above is variably adjustable only to a limited extent. A dynamic characteristic of the variable-displacement pump is in particular established by setting nozzles and spring stiffnesses on the pump regulator and is fixed and no longer variable with a view to the operation in a pressurizing medium supply assembly. Furthermore, a dynamic characteristic of the variable-displacement pump is a function of the pump pressure. Influencing variables which define a dynamic characteristic of the system include in particular the rotating speed, the pump pressure, the temperature of the pressurizing medium, a pressurizing medium volume in the hydraulic lines, a stiffness of the hoseline/pipeline installation, a kinematic characteristic of work equipment, a nominal differential pressure, and external disturbance forces. The variable-displacement pump must guarantee the highest dynamic characteristic and stability in all situations. A compromise in term of the basic layout of the variable-displacement pump is therefore necessary. The system described rapidly becomes susceptible to vibrations in a work machine, since different consumers such as, for example, hydro cylinders or hydro machines, display different reactions to the system. This can lead to movement of consumers being considered jolting, since the variable-displacement pump does not have an optimal dynamic characteristic in all situations.

In contrast, the disclosure is based on the object of achieving a hydraulic pressurizing medium supply assembly which in terms of devices is designed in a simple and cost-effective manner and displays a comparatively high level of dynamic characteristic and stability. It is moreover the object of the disclosure to achieve a method and a mobile work machine for the pressurizing medium supply assembly.

SUMMARY

According to the disclosure, a hydraulic pressurizing medium supply assembly for an open hydraulic circuit, in particular for mobile work machines, is provided. Said hydraulic pressurizing medium supply assembly has a hydro machine, in particular a variable-displacement pump, for the supply of pressurizing medium of at least one hydraulic consumer. The pressurizing medium supply assembly can furthermore have a hydraulic control block which has one or a plurality of valves or valve plates. Said hydraulic control block serves for controlling the at least one consumer. The hydro machine is preferably connected to the control block. The pressurizing medium supply assembly can furthermore have a first control module and a second control module. The control block by way of the first control module is able to be controlled by at least one actuating signal or actuating signals. A data interface is advantageously provided between the control modules. For example, the control modules to this end have a common data line to which said control modules are connected. It is preferably provided that the first control module by way of the data interface as a further actuating signal provides to the second control module as input variable/variables a nominal outlet pressure, the latter being detected on the outlet side of the hydro machine, for example, or a pump pressure for the hydro machine and/or a nominal delivery volume, or a nominal swivel angle for the hydro machine, and/or a nominal torque for the hydro machine. The second control module by means of the nominal outlet pressure and/or of the nominal delivery volume and/or of the nominal torque can then preferably control an adjusting mechanism or an adjustment of the hydro machine by way of a valve actuating signal. It is advantageously provided that at least one hydraulic parameter and/or one further actuating signal is transmitted, in particular from the first control module, to the second control module by way of the data interface. The hydraulic parameter and/or the further actuating signal herein are/is designed in such a manner that said hydraulic parameter and/or said further actuating signal predefine/predefines and/or limit/limits a dynamic characteristic of the adjusting mechanism of the hydro machine. The parameter is, for example, a maximum gradient or a maximum variation rate for the actual outlet pressure and/or for the actual delivery volume and/or for an actual output and/or for an actual torque.

This solution has the advantage that a dynamic characteristic of the hydro machine is adjustable in a simple manner by the pressurizing medium supply assembly. The setting of the dynamic characteristic then takes place by way of the hydraulic parameter and/or by way of the further actuating signal. It is thus advantageous that usual hydromechanical damping measures otherwise required are more easy to configure by the user or the machine manufacturer and implemented so as to be more easily defined by parameters in the limitation of the dynamics of the control of the hydro machine.

The system behavior of the pressurizing medium supply assembly, in particular a vibration behavior, a control behavior, a driving impression when used in a mobile work machine, is significantly varied by the dynamic characteristic of the hydro machine. Since the latter is able to be explicitly predefined and set by way of the hydraulic parameter and/or by way of the further actuating signal, the behavior of an entire pressurizing medium supply assembly can be more docile and more readily adapted, for example.

A maximum gradient or a maximum variation rate of one or a plurality of actual variables of the pressurizing medium supply assembly is advantageously provided as a parameter. The dynamic characteristic of the pressurizing medium supply assembly can thus be directly influenced in that the gradient of one or a plurality of actual variables is taken into account while controlling. A maximum delivery-volume adjustment rate or a delivery-volume adjustment rate target for an actual delivery volume of the hydro machine is provided as a parameter, for example. Alternatively or additionally, it is conceivable for a maximum pressure gradient for the actual outlet pressure of the hydro machine to be used as a parameter. Furthermore, alternatively or additionally, a nominal differential pressure and/or a nominal torque and/or the maximum gradient of the actual torque of the hydro machine can be provided as a parameter.

In a further design embodiment of the disclosure, alternatively or additionally to the nominal outlet pressure and/or to the nominal delivery volume, a nominal torque as an actuating signal or an input variable for the second control module can be supplied by way of the data interface in particular from the first control module. The hydro machine can thus also be controlled in a simple manner as a function of the nominal torque and/or of a nominal output.

In a further design embodiment of the disclosure, the at least one hydraulic parameter, or part of the parameters, or all parameters, is/are adjustable, as has already been set forth above, so as to influence the dynamic characteristic also during the operation of the pressurizing medium supply assembly, for example. Adapting the parameters or the parameter preferably takes place as a function of state variables of the pressurizing medium supply assembly and/or as a function of a target of a user. A temperature of a pressurizing medium can be considered as a state variable, for example. This herein can be the pressurizing medium at the outlet side or at the outlet of the hydro machine, for example. Alternatively or additionally, it can be provided that setting or adapting takes place as a function of an actual rotating speed of the hydro machine, or as a function of an actual outlet pressure of the hydro machine, and/or as a function of an actual delivery volume and/or swivel angle of the hydro machine. The dynamic characteristic of the pressurizing medium supply assembly can be adapted with high precision in a simple manner by adjusting the parameter/parameters based on one or a plurality of actual variables.

It is furthermore advantageous that the dynamic characteristic on the one hand, and also nominal variables for controlling the hydro machine, for example, on the other hand, can be adapted by way of the at least one hydraulic parameter. This takes place, for example, as a function of an operating point of the hydro machine, thus for example as a function of an actual volumetric flow or of an actual outlet pressure. Alternatively or additionally, this may also be a function of a load of consumers and/or of nominal variables such as, for example, a pressure gradient, a load pressure, or a gradient of an angle, in order to reduce vibrations and to improve the quality of movement. The determination of said states preferably takes place electronically. Overall, an improved rate of efficiency can be achieved by way of the hydraulic pressurizing medium supply assembly according to the disclosure. Moreover, more simple integration in a mobile work machine, for example, is enabled and fewer components are required in comparison to the prior art. In other words, it is extremely advantageous for the dynamic characteristic of the hydro machine to be adapted to the respective operating state so as to overall achieve a maximum dynamic characteristic combined with maximum stability. The dynamic characteristic of the hydro machine can be electronically mastered on account of the at least one hydraulic parameter. For this reason, components such as, for example, damping nozzles or damping hoses, overriding valves, or hydro-mechanical elements in the system such as, for example pressure distributor circuits in slewing gears, are no longer required for influencing the dynamic characteristic.

In one preferred design embodiment of the disclosure, the parameter, or the parameters, are able to be adjusted as a function of the consumer/consumers actuated by way of the hydraulic pressurizing medium supply assembly. The adjustment takes place in particular based on the consumer/consumers being moved. The dynamic characteristic can thus be even better influenced by way of the at least one parameter.

The parameter in the form of the maximum pressure gradient is preferably a function of an actual rotating speed and/or a function of an available torque gradient for the actual torque of a drive unit driving the hydro machine. The drive unit is, for example, an internal combustion engine, in particular a diesel engine, or an electric motor.

Adapting the parameter in the form of the maximum nominal differential pressure preferably takes place in such a manner that a maximum nominal differential pressure is provided in normal operation, and/or an in particular lower maximum nominal differential pressure is provided in a precision-control range of a consumer, and/or an in particular higher maximum nominal differential pressure is provided in an aggressive or rapid or general control range of a consumer. Alternatively or additionally, it is conceivable that an adapting of the parameter in the form of the nominal differential pressure is provided as a function of the type of internal combustion engine, for example of the type of diesel engine, and/or as a function of the available actual torque of the drive unit. Alternatively or additionally, it is conceivable for adapting the parameter in the form of the nominal differential pressure to take place as a function of a "bucket shake" and/or as a function of a driving operation of a mobile work machine comprising the pressurizing medium supply assembly. This means for example, that adapting takes place when travel of the mobile work machine is detected. In the case of bucket shake, a rapid reciprocating movement of a joystick for the bucket cylinder takes place so as to shake material from the bucket. A dynamic characteristic of the pump herein is to be particularly high so that the bucket can be positively shaken.

In a further design embodiment of the disclosure, adapting the parameter in the form of the maximum nominal torque and/or in the form of the maximum nominal differential pressure can take place as a function of a battery charging state of a battery of a drive unit for the hydro machine in the form of an electric machine, in particular in the form of an electric motor. Alternatively or additionally, it can be provided that adapting the maximum nominal torque takes place as a function of a type of electric machine and/or as a function of a temperature of the battery.

The parameter in the form of the maximum pressure gradient and/or in the form of the maximum delivery-volume adjustment rate is preferably a function of the consumer/consumers actuated by way of the hydraulic pressurizing medium supply assembly.

Controlling the speed of the mobile work machine when driving the mobile work machine which uses the pressurizing medium supply assembly can take place by way of the parameter in the form of the maximum differential pressure or the nominal differential pressure or the pressure gradient, for example. The mobile work machine here is driven by way of a hydraulic drive which is supplied by the pressurizing medium supply assembly, for example. Driving at a limited speed can thus be implemented in a simple manner in the open hydraulic circuit.

It is also conceivable for the parameter in the form of the maximum pressure gradient or the maximum torque or the maximum gradient of the actual torque to be adapted as a function of a compression release and/or of a drop in the rotating speed of the diesel engine.

In a further design embodiment of the disclosure, the parameter in the form of the maximum delivery volume can be a function of an operator request, thus be adjustable by a user, for example. On account thereof, a maximum speed of a movement of the consumer or of the consumers can be limited as required in a simple manner.

A consumer or a plurality of consumers in the form of hydro cylinders is/are preferably provided. The hydro cylinder here can have a piston which is connected to a piston rod and delimits at least one pressurized chamber, for example. A dynamic characteristic of the consumer can be controlled by the pressurizing medium supply assembly according to the disclosure, in particular by limiting the actual pressure gradient of the pump. For example, it is conceivable that the piston in the direction of a pressurized chamber decreasing in size, in particular at the end of the displacement path of the piston, is decelerated by the control so as to avoid an impact on the cylinder housing, or so as to at least reduce an impact velocity. Large pressure peaks can be avoided on account thereof. This may be referred to as electronic terminal position damping. In contrast, complex measures in terms of device technology are required to this end in the prior art.

In a further design embodiment of the disclosure, it is conceivable for the pump dynamic characteristic or the parameters to be adapted as a function of a working function of the mobile work machine. For example, when the mobile work machine in the form of a excavator is used for excavation work, said work machine will have a pump dynamic characteristic which is different from that when undertaking handling work.

Vibrations of the pressurizing medium supply assembly can be advantageously detected and/or calculated by way of corresponding means, wherein the parameter or the parameters in this instance is/are adapted as a function thereof.

In one preferred solution it is conceivable that adapting of the parameter/parameters takes place as a function of a stored travel distance model. A travel distance model is, for example, the distance travelled by the mobile work machine which comprises the pressurizing medium supply assembly. The type of mobile work machine such as, for example, a excavator, the kinematic characteristic thereof, hydraulic capacities of the hydraulic components, inertia characteristics of the consumers, gearing ratios, etc., can be taken into account in the travel distance, for example. It is conceivable that different travel distance models are provided for different hardware configurations.

In one preferred exemplary embodiment of the disclosure, adapting the parameter, in particular in the form of the maximum nominal outlet pressure, can be a function of a deflection of one or a plurality of operating elements such as, for example, a joystick. On account thereof, a feeling of force can be implemented in a simple manner for a user. In the case of minor operating targets, the movement of the consumer commences only once a load pressure is below the operating-element dependent limit, for example.

In a various further design embodiment of the disclosure it is conceivable for operating modes to be able to be set. In this instance, at least one pre-set parameter and/or one pre-set actuating signal for the dynamic characteristic of the adjustment of the hydro machine can be provided in a respective operating mode. The operating modes in this instance can differ from one another in terms of the value of at least one parameter thereof, and/or in terms of the value of the at least one actuating signal thereof. Different operating modes can thus be set, for example a dynamic mode or a precision-control mode, in which the different parameters in terms of the dynamic characteristic of the hydro machine are pre-set.

As an operating mode it can be provided, for example, that adapting the, in particular maximum, pressure gradient and/or the, in particular, maximum swivel angle gradient and/or of the, in particular maximum, angle gradient takes place as a function of the consumer which is being moved. Alternatively or additionally, it can be provided as an operating mode that adapting of the maximum pressure and/or the maximum nominal outlet pressure or the maximum actual outlet pressure takes place as a function of a deflection of an operating element or of a plurality of operating elements such as, for example, one or a plurality of joysticks. Alternatively or additionally it can be provided as an operating mode that adapting a parameter takes place when a specific operating or actuating situation is detected, such as, for example, the parameter delta p or the nominal differential pressure when bucket shake is detected. Alternatively or additionally, it can be provided as an operating mode that adapting the torque limit and/or the maximum nominal torque and/or the maximum actual torque takes place as a function of an operating state of an electric drive such as, for example, a battery charge and/or an electric motor temperature and/or a battery temperature. The electric drive is part of the mobile work machine set forth hereunder, for example.

The adjusting mechanism preferably has an actuating cylinder having a set piston for adjusting the delivery volume of the hydro machine, and a pilot valve which is electrically actuatable in a proportional manner. An inflow to and/or an outflow from a control chamber of the actuating cylinder that is delimited by the set piston is in this instance able to be controlled by way of the pilot valve, for example. On account thereof, the set piston for actuation can be impinged with a pressurizing medium.

In a further design embodiment of the disclosure, at least one filter can be provided for at least one input variable, or a respective filter can be provided for part of the input variables or for all input variables in the second control module. A filtered input variable, or part of the filtered input variables, or all filtered input variables can preferably be transmitted to the first control module. An output of filtered stable actual variables to the superordinate control or to the first control module can thus take place.

A control variable for the pilot valve is preferably provided as an output variable of the second control module. It is conceivable for the second control module to have a first closed-loop control circuit for the actual outlet pressure of the hydro machine. Said actual outlet pressure is preferably detected between a high-pressure connector of the hydro machine and the control block. Alternatively or additionally, the first closed-loop control circuit can be provided for the actual delivery volume of the hydro machine.

If the hydro machine is an axial piston machine having an adjustable swivel cradle or swash plate for setting a delivery volume, for example the actual delivery volume can then be detected by way of a corresponding means, for example by way of a swivel angle sensor such as, for example, a displacement transducer for the set piston. As an alternative to the displacement transducer, a swivel angle of the swash plate on the pivot axle can also be detected by way of a Hall sensor. In other words, measuring means for detecting the displacement position or the displaced volume is provided. It would also be conceivable for the swivel angle to be determined by way of a torque of the driveshaft or by measuring pressure. A second closed-loop control circuit which can be provided for a delivery-volume adjustment rate is preferably subordinated to the first closed-loop control circuit. An actual delivery-volume adjustment rate, in particular derived from the actual delivery volume, of the hydro machine is preferably provided as an input variable for the second closed-loop control circuit. If the actual delivery-volume adjustment rate is determined by way of the actual delivery volume, the actual delivery volume detected can advantageously be used for the first closed-loop control circuit as well as for the second closed-loop control circuit, this rendering a separate detection of the actual delivery-volume adjustment rate unnecessary. An output variable of the second closed-loop control circuit is preferably the control variable for the pilot valve. A control value in the form of a delivery-volume adjustment rate from the first closed-loop control circuit can advantageously be supplied to the second closed-loop control circuit. The control value from the first closed-loop control circuit can in this instance be a nominal variable for the second closed-loop control circuit.

The first closed-loop control circuit of the control can furthermore be configured for an actual torque of the hydro machine. In this instance, a nominal torque and an actual torque are provided as input variables for the control, for example. Alternatively or additionally, it is conceivable for the first closed-loop control circuit of the control to be configured for an actual output while including an actual rotating speed of the hydro machine. It is also conceivable for the actual output or the actual torque to be able to be determined from the actual rotating speed by way of a characteristic line, so as to then control the actual output. A controller, in particular a P-controller, can be provided for controlling the actual torque. Alternatively, it is conceivable for the controller to be configured as PI-controller or as PID controller.

In a further design embodiment of the disclosure, the first closed-loop control circuit has in each case one control variable for the actual outlet pressure of the hydro machine and/or for the actual delivery volume of the hydro machine and/or for the actual torque of the hydro machine. The control in this instance can provide alternating controlling which comprises a minimum value generator for the emitted control variables of the first closed-loop control circuit. An output variable of the minimum value generator in this instance is preferably the control value in the form of the delivery-volume adjustment rate that is supplied to the second closed-loop control circuit. The minimum value generator ensures that only the controller assigned to the desired operating point is automatically active. For example, the minimum value generator selects the lowest of the supplied control variables and then supplies said lowest control variable as the nominal delivery-volume adjustment rate to the subordinate second closed-loop control circuit.

The first closed-loop control circuit preferably has a controller for the delivery volume or the swivel angle (from which the delivery volume can be determined) of the hydro machine. Said controller is preferably a P-controller, for example. Alternatively, said controller can be configured as a PI-controller or as a PID-controller. The controller as an input variable can have a nominal swivel angle and an actual swivel angle, or a nominal delivery volume or actual delivery volume.

A filter, for example in the form of a PT1 element or a higher-grade filter, is preferably provided for the actual swivel angle. Pacification of the signal can take place in a simple manner by way of the filter.

The first closed-loop control circuit preferably has a controller for the actual outlet pressure of the hydro machine. Said controller is supplied the actual outlet pressure, in particular detected by way of a pressure sensor, as an input variable as well as the nominal outlet pressure. A PID-controller is preferably provided as a controller. A P-controller or a PI-controller can alternatively be used. The nominal outlet pressure of the hydro machine is preferably adjustable. In order for the nominal outlet pressure to be determined, an actual load sensing (LS) pressure of the consumers which are provided with a pressurizing medium by way of the pressurizing medium supply assembly is detected in particular. The actual LS pressure is in particular the highest actual load pressure of the consumers. The actual LS pressure is preferably supplied as an input variable to the control, or to the controller for the actual outlet pressure, respectively. In load sensing (LS) control, the highest load pressure is to be reported to the variable-displacement pump, and the variable-displacement pump is to be controlled in such a manner that an actual outlet pressure which is higher than the highest actual load pressure by a specific pressure differential (delta_p) prevails in the pump line. It is thus advantageously provided that the controller for the actual outlet pressure is additionally supplied a nominal differential pressure as an input variable. The nominal outlet pressure can then be calculated by adding the actual LS pressure and the nominal differential pressure and serve as an input variable for the controller. The nominal differential pressure can either be established as a fixed parameter or be adjustable and predefined as a flexible parameter.

It is in particular also conceivable for a plurality of actual LS pressures to be detected and for a maximum value to be generated or for prioritizing to take place in the control. This can take place by feedback to a main valve or to a main control valve, for example when a delivery quantity of the hydro machine (pump) is limited and the delivery quantity guided through the main valve can thus be limited, on account of which prioritizing hydraulic steering is enabled in the case of a supply deficit, for example. The hydro machine (pump) herein, in addition to LS-pressure guiding, is advantageously set to a minimum quantity so that the steering capability is ensured even in the case of erroneous information by a pressure sensor.

In a controller for the actual outlet pressure and/or for the actual delivery volume and/or for the actual torque, an I-proportion can be provided such as, for example, in a PID-controller, as is explained above. It can in this case be provided, in particular when using the minimum value generator, that the I-proportion is frozen, or is in particular partially or completely withdrawn, in the case of the controller or the controllers which are inactive and have an I-proportion. The I-proportion is used in the usual manner when the controller then becomes active. This leads to the I-proportion of the controller/controllers not being resorted to in the case of inactivity. This design embodiment can be referred to as an "anti-windup" design embodiment.

One or a plurality of filters having a pressure-dependent filter coefficient can advantageously be provided for the controller of the actual outlet pressure. The respective filter is, for example, a variable PT1 filter or a filter of a higher grade. The filter or a respective filter is preferably provided for the actual outlet pressure and/or for the actual LS pressure. The pressure-dependent filter is preferably designed in such a manner that filtering is reduced when the actual outlet pressure of the hydro machine increases, and filtering is conversely increased when the actual outlet pressure of the hydro machine decreases, in order to exert influence on the dynamic characteristic of the controlling.

Alternatively or additionally, one or a plurality of filters, in particular having pressure-dependent filter coefficients, in particular for one or a plurality of input variables, can be used for the controller as set forth further above and below.

Alternatively or additionally, it is conceivable for an asymmetric filter to be provided, in particular for the one or the plurality of input variables, for the controller of the actual outlet pressure and/or for one or a plurality of the controllers set forth above and below. Said asymmetric filter operates as a function of the direction in which the swash plate is pivoted. This means that the filter performance of the filter in the first pivoted direction is different in comparison with the filter performance in the second pivoted direction.

In a further design embodiment of the disclosure, an amplification factor (Kp) is provided in particular for the controller for the actual outlet pressure, said amplification factor (Kp) being a function of the actual temperature of the pressurizing medium of the hydro machine, in particular of the pressurizing medium at the outlet side, and/or of the actual rotating speed of the hydro machine and/or of the actual outlet pressure of the hydro machine and/or of a predefined pressure gradient or nominal pressure gradient, in particular for the nominal outlet pressure of the hydro machine. The amplification factor can thus be determined as a function of said variables. The amplification factor at the controller can then, for example, be multiplied with the control deviation, wherein the control deviation is, for example, the nominal LS pressure minus the actual LS pressure, and/or, for example, the nominal outlet pressure minus the actual outlet pressure. It is preferably provided that the lower the actual temperature the smaller the amplification factor, since vibrating of the hydro machine in the cold state of the hydro machine can preferably be prevented or at least minimized on account thereof. In an analogous manner, it can conversely apply that the higher the actual temperature the greater the amplification factor. Alternatively or additionally, it can be provided that the lower the actual rotating speed of the hydro machine the greater the amplification factor, since the build-up of pressure is a function of the volumetric flow and thus of the rotating speed of the hydro machine. In an analogous manner, it can conversely apply also here that the higher the actual rotating speed the smaller the amplification factor. Alternatively or additionally, it can be provided that the greater the pressure gradient of the nominal outlet pressure the greater the amplification factor. This is advantageous as the greater the pressure gradient the higher the requirement for deflecting the hydro machine, and the hydro machine thus has to react more rapidly than in the range of a minor signal. Conversely, it in this instance also applies here that the smaller the pressure gradient the smaller the amplification factor. Alternatively or additionally, it can be provided that the higher the actual outlet pressure the greater the amplification factor. This is advantageous since the dynamic characteristic of the travel distance is also higher at a higher actual outlet pressure. The hydro machine can thus be more rapidly pivoted without becoming unstable. The same correlation applies vice versa.

The amplification factor can advantageously be configured as a control parameter dependent on an operating point. It can apply to controlling the pressure and/or to controlling the torque and/or to controlling the swivel angle that the higher the actual outlet pressure the higher the amplification factor can be, or the amplification factor is increased up to a predetermined actual outlet pressure and is subsequently lowered again at a further increasing actual outlet pressure. In other words, an amplification factor can also be provided in the controllers for the actual outlet pressure and/or for the actual torque, in particular for the actual variables. In other words, adapting the closed-loop control circuit amplifications as a function of pressure can in particular be provided. The control parameters can thus be adapted in the operation of the pressurizing medium supply assembly. Adapting the dynamic characteristics of controlling to meet requirements advantageously takes place during operation.

In a further design embodiment of the disclosure it can be provided that the nominal pressure gradient or the maximum nominal pressure gradient is provided for the controller of the actual outlet pressure. Said nominal pressure gradient is preferably adaptable and adjustable. The nominal pressure gradient in this instance can influence the nominal outlet pressure, for example. An influence may take place in such a manner, for example, that the higher the nominal pressure gradient the faster the hydro machine is to deflect. The higher the nominal pressure gradient the more rapid the increase in terms of the requirement as the actual gradient, which is why the hydro machine is more rapidly pivoted in order to achieve the nominal pressure gradient. It is conceivable for the nominal pressure gradient to be used as a delimitation for the nominal outlet pressure or as a delimitation for the variation of the nominal outlet pressure.

In a further design embodiment of the disclosure the first closed-loop control circuit preferably has a controller for the actual torque or for the actual output based on the actual torque being multiplied by the actual rotating speed. An actual rotating speed which, in particular by way of a speed sensor, is detected on a driveshaft of the hydro machine can be provided as an input variable. The actual torque or the absorbed torque of the hydro machine (pump) can then be calculated from the actual rotating speed. The actual torque is also calculated from the actual swivel angle multiplied by the actual outlet pressure divided by the hydro-mechanical rate of efficiency. The hydro-mechanical rate of efficiency is a function derived from the actual outlet pressure, from the actual swivel angle, and from the actual rotating speed and can be determined, for example, by way of a characteristic line. A nominal torque can furthermore be provided for the controller. The control variable of the controller at the outlet side is preferably supplied to the minimum value generator. The characteristic line for determining the actual torque is a function, for example, of the actual pressure and/or of the actual swivel angle. In other words, a momentary output can be calculated by way of the controller, in particular when the actual rotating speed is included.

In a further design embodiment of the disclosure, the actual variables for the first closed-loop control circuit and the second closed-loop control circuit, or part of the actual variables, and one or a plurality of derivations thereof, are filtered in order for the signals to be pacified. A PT1 element or a variable PT1 element as already described above is used here, for example.

As has already been explained above, it is conceivable for a delivery-volume adjustment rate target or a maximum delivery-volume adjustment rate for the second control module to be provided, said delivery-volume adjustment rate target or said maximum delivery-volume adjustment rate being able to be supplied to the second closed-loop control circuit in particular downstream of the minimum value generator. The maximum delivery-volume adjustment rate is in particular supplied to the control by way of a control element. Said control element as an input variable preferably has the control value from the first closed-loop control circuit, thus the control value emitted by the minimum value generator. The delivery-volume adjustment rate target can be provided as a further input variable. The final nominal delivery-volume adjustment rate for the second closed-loop control circuit can then be provided as the output variable of the control element. The control value of the minimum value generator is in particular delimited by way of the additionally predefined delivery-volume adjustment rate target which is adjustable, for example, in order to influence a control dynamic characteristic of the pressurizing medium supply assembly. The delivery-volume adjustment rate target can be, for example, a positive or negative maximum of the delivery-volume adjustment rate. The higher the final nominal delivery-volume adjustment rate the faster the hydro machine is able to deflect.

The control dynamic characteristic of the pressurizing medium supply assembly can be influenced in a simple manner by way of the adjustable maximum nominal pressure gradient and/or the adjustable delivery-volume adjustment rate target explained above. The control force acting on the pilot valve can thus be a function of nominal pressure gradients and/or of the delivery-volume adjustment rate target. Said values can be adapted in a variable manner during operation. Adapting the control dynamic characteristic to requirements can thus take place during operation and be a function of the operating point or the working point, for example. The dynamic characteristic of the pump can thus be limited and/or adapted by the value or values. The swivel angle of the hydro machine and/or the delivery-volume adjustment rate can in this instance be controlled in such a manner that the nominal value or the nominal values are not exceeded. In other words, adapting the dynamic characteristic of the pressurizing medium supply assembly by way of the adjustable variables (in particular the maximum nominal pressure gradient and/or in particular the adjustable delivery-volume adjustment rate target) can take place by way of software parameters, a soft or a harsh machine behavior being able to be set hereby, for example. The dynamic characteristic is also variable in terms of sub-functions. A sub-function can be adapted using the nominal pressure gradient, and the other sub-function can be adapted using the delivery-volume adjustment rate target. A reduction of vibrations is also enabled by adapting the dynamic characteristic. Furthermore, jolting movements can be avoided. It has been demonstrated that the hydraulic pressurizing medium supply assembly leads to an increase in terms of the rate of efficiency, in particular by way of a decrease in the consumption of control fluid.

In other words, a method which is provided for controlling a swept volume and/or a torque and/or a pressure of a hydrostatic machine is disclosed. Said hydrostatic machine can have an actuating device for setting the swept volume of said hydrostatic machine. The method preferably comprises the following steps:

- detecting a predefined nominal torque;
- detecting a predefined nominal swept volume;
- detecting a predefined nominal pressure;
- detecting an actual swept volume or a set swept volume;
- detecting an actual pressure or a set pressure;
- determining the actual torque or the set torque on the driveshaft of the machine.

Controlling a volumetric flow into the actuating device or out of the actuating device by means of a control valve for setting the swept volume based on a forced differential between a control force and a force which engages in the opposite direction on the control valve can be provided as a further step. The force which engages in the opposite direction to the control force on the control valve can be a spring force. The control force can furthermore be an electric force of a solenoid valve. The machine is set as a function of the detected swept volume and/or pressure and/or nominal swept volume and/or nominal pressure and/or nominal torque. The swept volume is preferably set such that the smallest swept volume which leads to the nominal variables being achieved is at all times set.

As has been explained at the outset, the volumetric flow of the hydro machine or the variable-displacement pump can be determined from the swivel angle of the swash plate. When the variable-displacement pump is not being driven and pressure is absent in the actuating system, the variable-displacement pump, on account of a spring force of a spring, pivots toward a maximum delivery volume, for example. In contrast, the variable-displacement pump in the driven state of the variable-displacement pump and with a non-energized pilot valve and a closed pump outlet pivots toward a zero-stroke pressure. An equilibrium between the pump pressure at the set piston and the spring force of the spring is established at approximately 4 to 8 bar. The initial position is usually assumed when the control electronics are de-energized. Conversely, it would also be conceivable for the variable-displacement pump with a de-energized pilot valve to be pivoted to a maximum delivery volume so as to ensure the supply of a consumer, such as a steering box, for example, with a pressurizing medium. A pressure limiting valve is preferably provided in this instance in order for the actual outlet pressure of the hydro machine to be limited.

The pressurizing medium supply assembly is preferably used for mobile work machines which have a load sensing (LS) system or a LUDV-controlled system. Said systems can have a limitation of torque and/or a limitation of the angle of a swivel angle of the hydro machine, for example in the form of an adjustable axial piston machine. A compact mini backhoe or a wheel loader is provided as a mobile work machine, for example.

Dynamic and simultaneous parallel controlling of main process variables such as, for example, an actual pressure, an actual differential pressure, an actual torque and/or an actual swivel angle is enabled by way of the hydraulic pressurizing medium supply assembly. This leads to an extremely flexible use in almost all open hydraulic circuits, and the further comparison with solutions to date enables the possibility of influencing the hydraulic system in particular also during operation. Adapting the dynamic characteristics to requirements, for example for different load situations and/or for different drivers, during the operation on the mobile work machine by way of the parameters can take place via the data interface or the software interface. In contrast to the prior art, in order for the dynamic characteristic to be set no damping nozzles and/or hydraulic devices for manipulating the LS signals are necessary, on account of which a loss of control fluid is avoided or at least minimized. This leads to an increase in the rate of efficiency. Moreover, simple integration of the hydraulic pressurizing medium supply assembly in the mobile work machine is enabled. For example, hydraulic hose connections or lines on the hydro machine are dispensed with, and LS line/lines is/are also no longer required, for example, on account of which costs can be reduced.

Sensors can be provided for detecting the actual variables. One or a plurality of sensors for detecting the load pressure or the load pressures of the consumer or consumers can be provided here, for example. It is also conceivable for a sensor to be used for the actual outlet pressure. A sensor for an actual rotating speed of the hydro machine can be provided as a further sensor. It is also conceivable for a sensor to be used for measuring the temperature.

A mobile work machine having the hydraulic pressurizing medium supply assembly is preferably provided.

BRIEF DESCRIPTION OF THE DRAWINGS

Preferred exemplary embodiments of the disclosure will be explained in more detail hereunder by means of schematic drawings, in which.

DETAILED DESCRIPTION

Figure 1:
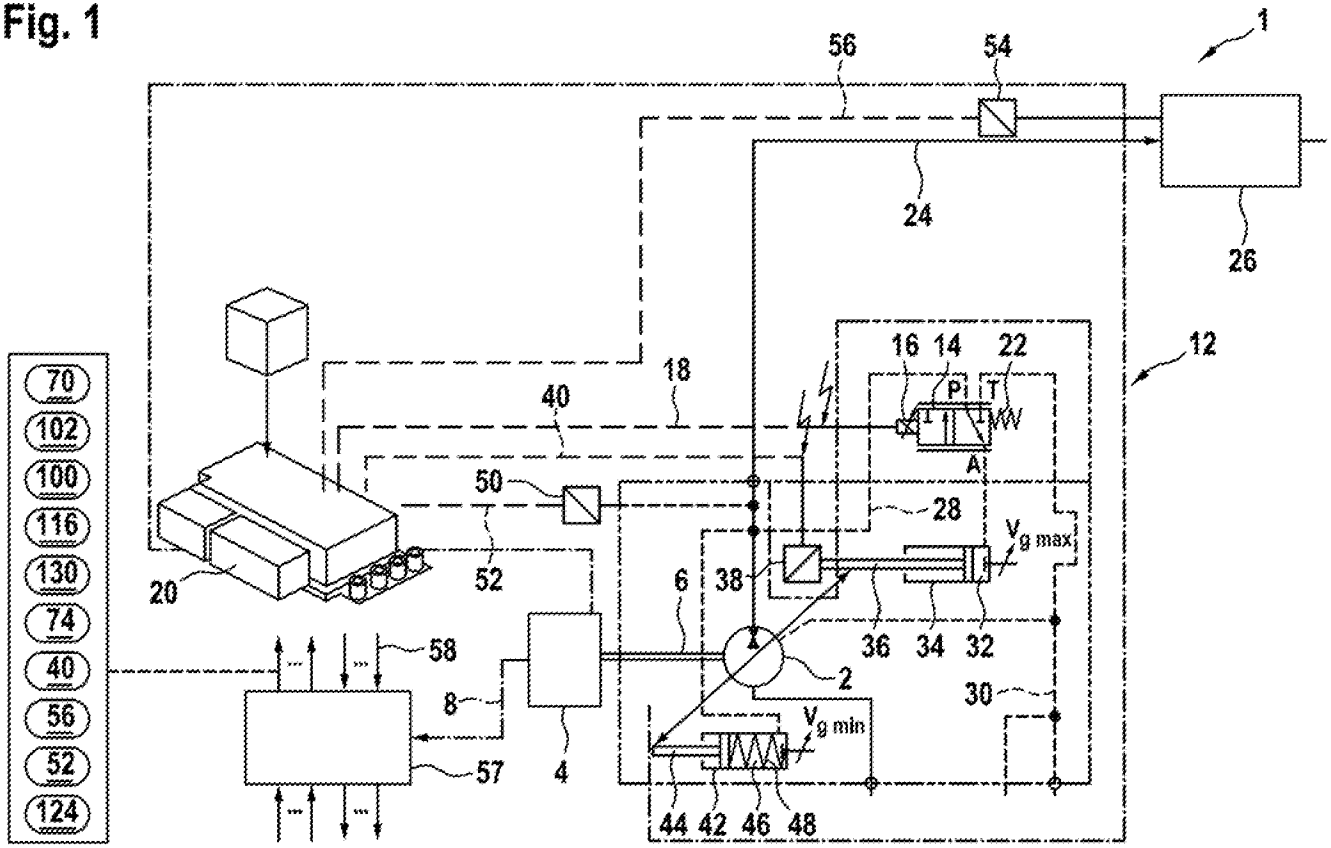
FIG. 1 in a schematic illustration shows a hydraulic pressurizing medium supply assembly according to a first exemplary embodiment.

Shown according to FIG. 1 is a hydraulic pressurizing medium supply assembly 1 which has a hydro machine in the form of an axial piston machine 2. Said axial piston machine 2 has a swivel cradle for adjusting a delivery volume. The axial piston machine 2 can be used as a pump as well as a motor. The axial piston machine 2 is driven by a drive unit 4 which can be, for example, an internal combustion engine such as, for example, a diesel engine, or an electric motor. The axial piston machine 2 is connected to the drive unit 4 by way of a drive shaft 6. A rotating speed 8 of the drive shaft 6 can be detected by way of means not illustrated, for example by way of a speed sensor, and be supplied to a control of the pressurizing medium supply assembly 1. An adjusting mechanism 12 is provided for the axial piston machine 2. Said adjusting mechanism 12 has a pilot valve 14. The valve slide of said pilot valve 14 is electrically actuatable in a proportional manner by way of an actuator 16. To this end, the actuator 16 is supplied a control variable 18 by a second control module 20. The valve slide of the pilot valve 14 in the direction of an initial position is impinged with a spring force of a valve spring 22. The spring force acts counter to the actuating force of the actuator 16.

The axial piston machine 2 at the outlet side is connected to a pressure line 24 which in turn is connected to a main control valve 26 or a valve block. The supply of pressurizing medium between the axial piston machine 2 and one or a plurality of consumers can be controlled by way of said main control valve 26. A control line 28 which is connected to a pressure connector P of the pilot valve 14 branches off from the pressure line 24. An internal supply of the axial piston machine 2 herein can be guaranteed by a corresponding construction. The control line 28 is configured, for example, in a housing of the axial piston machine 2. The pilot valve 14 furthermore has a tank connector T which by way of a tank line 30 is connected to a tank. The pilot valve 14 moreover has an operation connector A which is connected to a control chamber 32 of an actuating cylinder 34. The control chamber 32 herein is delimited by a set piston 36 of the actuating cylinder. A swash plate of the axial piston machine 2 can in this instance be adjusted by way of the set piston 36. A displacement path of the set piston 36 is detected by a displacement transducer 38. Alternatively or additionally, a swivel angle of the swivel cradle of the axial piston machine 2 is detected on a swivel axle of the swivel cradle by way of a rotary magnetic sensor. The actual delivery volume or the actual displacement volume of the axial piston machine 2 can in this instance be determined by way of the detected path. The actual delivery volume 40 is then reported to the control 20. The pressure connector P in the initial position of the valve slide of the pilot valve 14 is connected to the operation connector A, and the tank connector T is blocked. When the valve slide is impinged with the actuating force of the actuator 16, the valve slide, proceeding from the initial position thereof, is moved in the direction of switched positions in which the pressure connector P is blocked and the operation connector A is connected to the tank connector T. The set piston 36 in the initial position of the valve slide of the pilot valve 14 is thus impinged with pressurizing medium from the pressure line 24. Furthermore provided in the adjusting mechanism 12 is a cylinder 42. The latter has a set piston 44 which engages on the swash plate of the axial piston machine 2. The set piston 44 limits a control chamber 46 which is connected to the pressure line 24. The set piston 44 by way of pressurizing medium of the control chamber 46 and by way of the spring force of the spring 48 is impinged in such a manner that said set piston 44 loads the swash plate in the direction of increasing the delivery volume.

Furthermore provided is a pressure sensor 50 by way of which the pressure in the pressure line 24 is detected and reported to the second control module 20, wherein the pressure is an actual outlet pressure 52. Moreover provided is a pressure sensor 54 which detects the highest actual load pressure (actual LS pressure) 56, the latter being transmitted to the second control module 20.

A first control module 57 by way of a CAN interface 58 is connected to the second control module 20, in particular for transmitting the actual rotating speed 8 to the second control module 20. It is also conceivable for the actual rotating speed 8 to be supplied directly to the second control module 20.

The position of the swash plate of the axial piston machine 2 in the use of the pressurizing medium supply assembly 1 is controlled by way of the pilot valve 14 and the set piston 36. A conveyed volumetric flow of the axial piston machine 2 is proportional to the position of the swash plate. The set piston 44 pre-loaded by the spring 48, or the counter piston, is at all times impinged by the actual outlet pressure or the pump pressure. In a non-rotating axial piston machine 2 and an adjusting mechanism 12 without pressure the swash plate by the spring 48 is kept in a position of +100 percent. In a driven axial piston machine 2 and a non-energized actuator 16 of the pilot valve 14, the swash plate pivots to a zero-stroke pressure, since the set piston 36 is impinged with pressurizing medium of the pressure line 24. Equilibrium between an actual outlet pressure at the set piston 36 and the spring force of the spring 48 is established at a predetermined pressure or pressure range, for example between 8 to 12 bar. Said zero-stroke operation is assumed, for example, in the event of de-energized electronics or a de-energized second control module 20. The actuation of the pilot valve 14 takes place by way of the second control module 20, the latter being, for example, preferably digital electronics, alternatively analog electronics. The second control module 20 processes the required control signals, as is explained in more detail hereunder.

For example, a nominal delivery volume 70 or a nominal swivel angle or a maximum nominal pressure gradient 102 and/or a nominal pressure differential 100 and/or a nominal torque 116 and/or a maximum nominal delivery-volume adjustment rate 130 and/or a nominal outlet pressure 74 can be supplied from the first control module 57 to the second control module 20 by way of the data interface 58. It is furthermore conceivable for an actual delivery volume 40 or an actual swivel angle and/or an actual LS pressure 56 and/or an actual outlet pressure 52 and/or an actual torque 124 to be supplied from the second control module 20 to the first control module 57. The variables 40, 56, 52 and/or 124 herein are preferably filtered.

Figure 2:
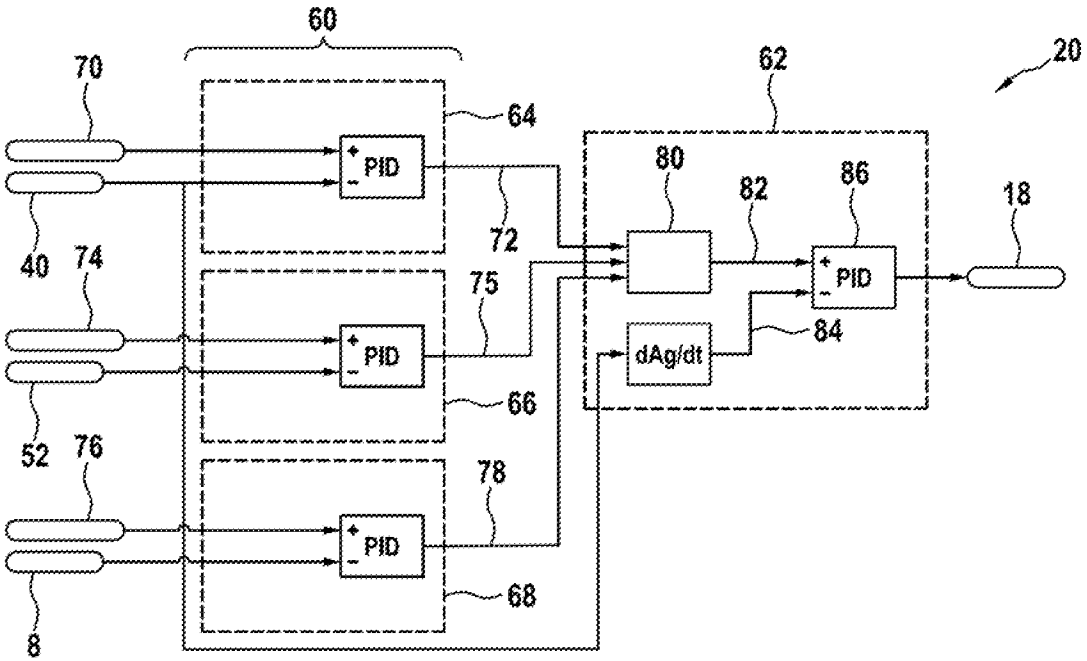
FIG. 2 in a schematic illustration shows a second control module for the pressurizing medium supply assembly from FIG. 1.

FIG. 2 schematically shows a functioning mode of the second control module 20. The latter has a first closed-loop control circuit 60 and a second closed-loop control circuit 62. The first closed-loop control circuit 60 has a controller 64 for a swivel angle of the swash plate of the axial piston machine 2 from FIG. 1, a controller 66 for the outlet pressure of the axial piston machine 2, and a controller 68 for a torque of the axial piston machine 2. The controller 64 as input variables has a nominal delivery volume 70 and the actual delivery volume 40. A control variable 72 is provided as an output variable. The controller 66 as input variables has a nominal outlet pressure 74 and the actual outlet pressure 52. A control variable 75 is provided as an output variable. The controller 68 as input variables has an actual torque 76 or a nominal torque. The actual torque which in turn is able to be determined, for example, by means of a characteristics map by way of the actual rotating speed 8 is provided as a further input variable. A control variable 78 is provided as an output variable for the controller 68. In the respective controller 64 to 68, the input variables are in each case supplied to a control element in the form of a PID controller.

The control variables 72, 75 and 78 are supplied to a minimum value generator 80. The latter ensures that only the controller 72, 75 or 78 assigned to the desired operating point is automatically active. Either the outlet pressure, the torque, or the delivery volume herein is precisely controlled, wherein the respective two other variables are below a predefined nominal value. An output signal of the minimum value generator 80 in this instance is a nominal value in the form of a delivery-volume adjustment rate or a nominal delivery-volume adjustment rate 82. The latter in this instance is an input variable for the second subordinate closed-loop control circuit 62. The derivation of the actual delivery volume 40 is a further input variable of the second closed-loop control circuit 62, said further input variable in this instance being an actual delivery-volume adjustment rate 84. The input variables 82 and 84 for the second closed-loop control circuit 62 are then supplied to a control element in the form of a PID element 86. The latter then emits the control variable 18 for the pilot valve 14 from FIG. 1.

Figure 3:
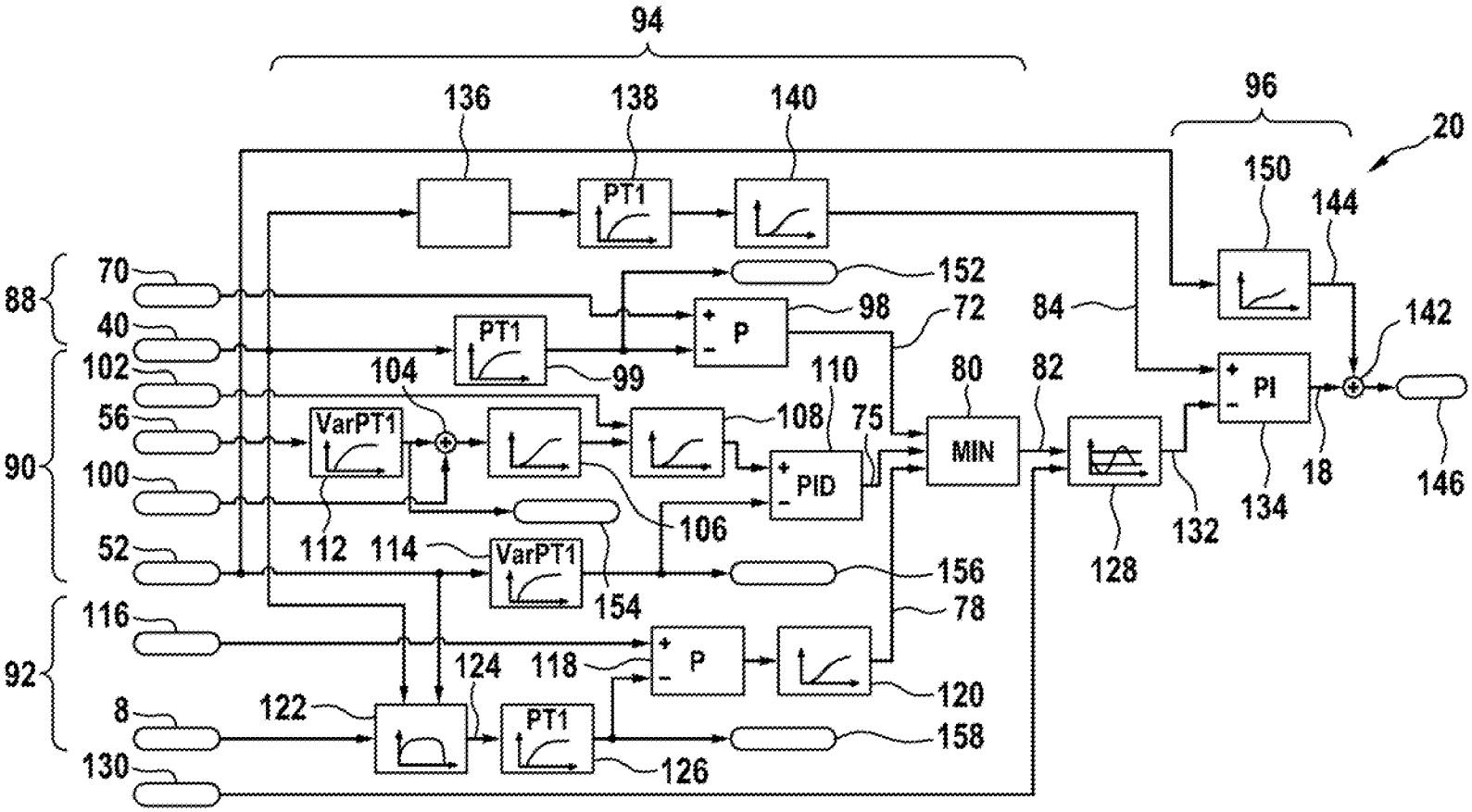
FIG. 3 in a schematic illustration shows a second control module for the pressurizing medium supply assembly from FIG. 1 according to a further exemplary embodiment.

According to FIG. 3, a further embodiment for the second control module 20 from FIG. 1 is shown. Said further embodiment has a controller 88 for the delivery volume of the axial piston machine 2, cf. also FIG. 1. Furthermore provided are a controller 90 for the outlet pressure of the axial piston machine 2 and a controller 92 for the torque of the axial piston machine 2. This forms part of a first closed-loop control circuit 94. Furthermore provided so as to underlie the first closed-loop control circuit is a second closed-loop control circuit 96 for the delivery-volume adjustment rate of the axial piston machine 2.

The controller 88 has a control element 98 in the form of a P-element. The nominal delivery volume 70 and the actual delivery volume 40 are provided as input variables. The actual delivery volume 40 is supplied to the control element 98 by way of a filter in the form of a PT1 filter. The control variable 72 is provided as the output variable at the output side of the controller 88, said control variable 72 being supplied to the minimum value generator 80.

The controller 90 as input variables has the actual outlet pressure 52, the actual LS pressure 56, a nominal pressure differential 100 and a nominal pressure gradient 102. The actual LS pressure 56 and the nominal pressure differential 100 by way of a summing element 104 are linked so as to form a nominal outlet pressure. The nominal outlet pressure is then supplied to a control element 106 in the form of an inverted PT1 element which estimates a predicted signal profile. The nominal outlet pressure is then furthermore supplied to a control element 108 which has the nominal pressure gradient 102 as a further input variable. The nominal pressure gradient 102 then predefines the maximum potential gradient which is to be provided. The nominal outlet pressure by way of the control element 108 is then influenced by the predefined nominal pressure gradient 102 in such a manner that the dynamic characteristic of the pressurizing medium supply assembly 1 from FIG. 1 can be controlled by the nominal pressure gradient 102. For example, the influence can be such that the higher the nominal pressure gradient 102 the more rapidly the swash plate of the axial piston machine 2 is able to be adjusted. It conversely applies in this instance that the smaller the nominal pressure gradient the slower the swash plate of the axial piston machine 2 is adjusted. After the control element 108, the nominal outlet pressure is then supplied to a control element 110 in the form of a PID element. The actual outlet pressure 52 is then provided as a further input variable for the control element 110. The control variable 75 which is supplied to the minimum value generator 80 results as the output variable of the control element 110.

The actual LS pressure 56 of the controller 90 prior to the summing element 104 is supplied to a filter 112 which is a variable PT1 filter. The same applies to the actual outlet pressure which prior to the control element 110 is likewise supplied to a filter 114 in the form of a variable PT1 filter. The filters 112 and 114 have variable, in particular pressure-dependent, filter coefficients, as is explained in more detail above.

The controller 92 as input variables has the actual rotating speed 8, the actual delivery volume 40, the actual outlet pressure 52, and a nominal torque 116. The input variables are supplied to a control element 118 in the form of a P-element. The control variable 78 which is supplied to the minimum value generator 80 is provided as an output variable for the control element 118. A control element 120 which, as in the case of the control element 106, is an inverted PT1 filter is provided for the control variable 78 after the control element 118. Furthermore, the actual rotating speed, the actual delivery volume 40, and the actual outlet pressure 8, prior to being supplied to the control element 118, are supplied to a control element 122. The latter serves for calculating an actual torque 124 based on the actual rotating speed 8, on the actual delivery volume 40, and the actual outlet pressure 8. The calculation is performed by means of a characteristics map of the control element 122. The characteristics map is a function of the actual outlet pressure 52 which is supplied to the control element 122.

The actual delivery volume 40 is furthermore supplied to the control element 122. The characteristics map in this instance can alternatively or additionally be a function of the actual delivery volume 40. In other words, the actual torque 124 is formed from the actual rotating speed 8 and from the actual outlet pressure 52 and/or from the actual delivery volume 40. The actual torque 124, prior to reaching the control element 118, is then subsequently supplied to a filter 126 in the form of a PT1 element.

Furthermore, the actual delivery volume 40, prior to being supplied to the control element 98, is supplied to a filter 99 in the form of a PT1 element.

The minimum value generator 80 from the control variables 72, 75 and 78 forms the nominal delivery-volume adjustment rate 82. The latter is supplied to a control element 128. The dynamic characteristic of the pressurizing medium supply assembly 1 can be influenced by said control element 128. To this end, a delivery-volume adjustment rate target 130, which is adjustable, is provided as a further input variable for the control element 128. For example, the nominal delivery-volume adjustment rate 82 which is emitted from the minimum value generator 80 can be limited and/or influenced in such a manner by way of the delivery-volume adjustment rate target 130 that the greater the variable 130 the faster the swash plate of the axial piston machine 2 can be pivoted and vice versa. The dynamic characteristic of the pressurizing medium supply assembly 1 can thus be influenced by adjusting the delivery-volume adjustment rate target 130 and/or by adjusting the nominal pressure gradient 102. On account thereof, the pressurizing medium supply assembly 1 can be adapted in a simple and cost-effective manner to different work machines and/or to different application conditions and/or to different specific applications, for example.

After the control element 128, the final nominal delivery-volume adjustment rate 132 as an input variable is supplied to the second closed-loop control circuit 96. The latter has a control element 134 in the form of a PI-element. The actual delivery-volume adjustment rate 84 is provided as a further input variable for the control element 134. Said actual delivery-volume adjustment rate 84 is based on the actual delivery volume 40 which is derived in a control element 136. Thereafter, the derivation, thus the actual delivery-volume adjustment rate, is supplied to a filter 138 in the form of a PT1 filter. Prior to the actual variable 84 being supplied to the control element 134, a control element 140 in the form of an inverted PT1 filter is subsequently provided. The control element 134 of the second closed-loop control circuit 96 has the control variable 18 as the output variable for the pilot valve 14 from FIG. 1. Said control variable 18 is supplied to a summing element 142. A preliminary control value 144 is provided as a further input variable for the summing element 142. Said preliminary control value 144 is an output variable of a control element 150 which has the actual outlet pressure 52 as the input variable. The preliminary control value 144 is then determined based on the actual outlet pressure 52. The summing element 142 then links the control variable 18 and the preliminary control value 144, a neutral current of the pilot valve being pre-controlled therewith. A pressure-dependent target of a neutral signal value for the pilot valve 14 from FIG. 1 is thus established. This has the advantage that the control 20 is relieved in terms of said control task. A final control variable 146 for the pilot valve 14 is then provided as an output variable of the summing element 142.

It is conceivable that a control element which is not illustrated in FIG. 3 and which has the control variable 146 as the input variable is disposed downstream of the summing element 142. Said control variable 146 is superimposed with a high-frequency signal by the control element, so that the valve slide of the pilot valve 14 is continually in axial oscillating movement so as to avoid seizing of the valve slide. The final control variable for the pilot valve 14 is in this instance provided as the output variable of the control element. The superimposition by the high-frequency signal can be referred to as "dithering".

According to FIG. 3, the actual delivery volume 40 after the filter 99, as a filtered actual delivery volume 152, can be supplied to the first control module 57 from FIG. 1. Furthermore, the actual LS pressure after the filter 112, as a filtered actual LS pressure 154, can be supplied to the first control module 57 from FIG. 1. The actual outlet pressure 52 after the filter 114, as a filtered actual outlet pressure 156, can likewise be supplied to the first control module 57. Moreover, the actual torque 124 after the filter 126, as a filtered actual torque 158, can be supplied to the first control module 57.

Figure 4:
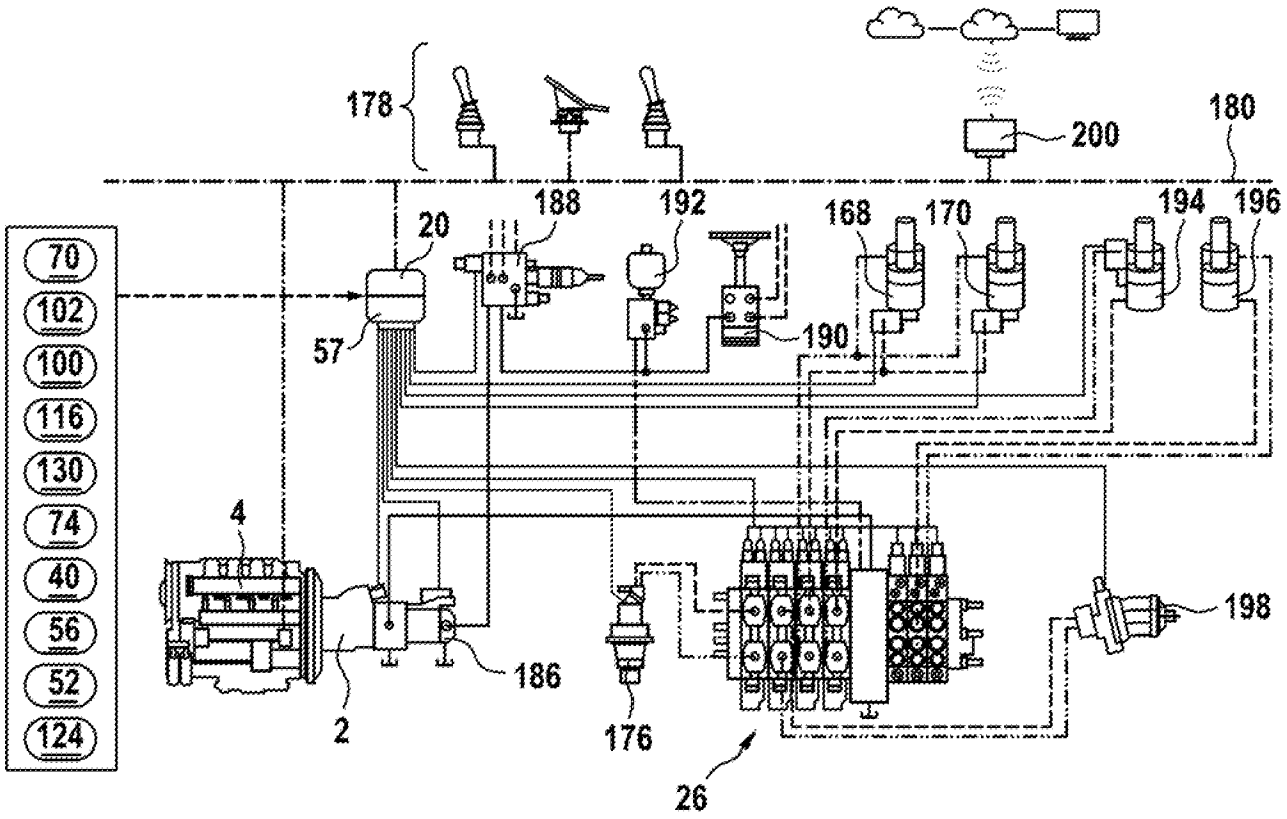
FIG. 4 in a schematic illustration shows a pressurizing medium supply assembly for a mobile work machine, according to a first exemplary embodiment.

FIG. 4 shows the pressurizing medium supply assembly for a mobile work machine in the form of a telehandler. Said telehandler has two axial piston machines 2 and 186 which by the drive unit 4 in the form of a diesel engine are driven by way of a common drive shaft. Pilot valves of the axial piston machine 2, 186 are controlled by way of the control 20, as has been explained above. The axial piston machine 186 serves for supplying pressurizing medium to a wheel brake 188, to a steering system 190, and to a pilot fluid supply 192. The pilot fluid supply 192 is provided for the main control valve 26, or the main control valve block, respectively. The supply of pressurizing medium to hydro cylinders 168, 170, 194, 196 is controlled by way of said main control valve block. A hydro machine 198 used and the hydraulic auxiliary motor 176 are furthermore controlled by way of the main control valve 26. Input means 178 which by way of the CAN bus 180 are connected to the second control module 20, for example, are provided. A communication installation 200 and is furthermore provided in order to communicate with a server and/or with a computer in a wireless manner, for example by radio or WiFi. For example, input variables for the second control module 20 can in this instance be adapted by way of the communication installation 200 and/or a software can be upgraded or updated by way of the communication installation 200. Moreover, it is possible for data which includes information pertaining to a state of the pressurizing medium supply assembly 1 to be sent by way of the communication installation 200. The control modules 20 and 57 according to FIG. 4 are disposed in a common housing. The data interface by way of which the variables 70, 102, 100, 116, 130, 74, 40, 56, 52 and 124 can be transmitted is provided within the housing.

Figure 5:
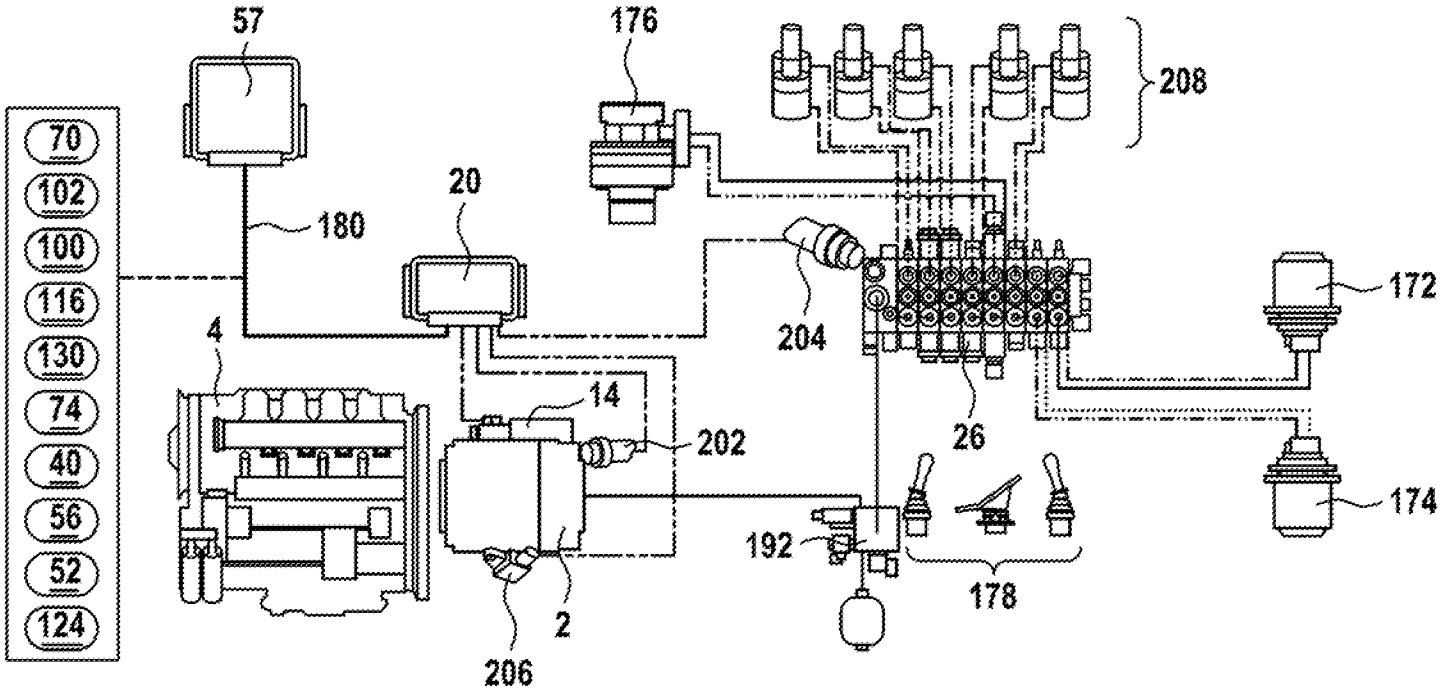
FIG. 5 in a schematic illustration shows a pressurizing medium supply assembly for a mobile work machine, according to a further exemplary embodiment.

According to FIG. 5, a pressurizing medium supply assembly for a compact excavator is shown. The axial piston machine 2 which is driven by the drive unit 4 in the form of a diesel engine can be seen herein. Furthermore shown is the second control module 20 which is connected to a pressure sensor 202, for example, which detects the actual outlet pressure of the axial piston machine 2. The second control module 20 is moreover connected to a pressure sensor 204 which by way of the main control valve 26, or the main control block, respectively, detects the highest load pressure. The second control module 20 is furthermore connected to a sensor 206 for the swivel angle of the swash plate of the axial piston machine 2. The pilot valve 14 is moreover connected to the second control module 20. Five hydro cylinders 208 are connected to the main control valve 26.

Furthermore connected are the hydro machines 172, 174, and the hydraulic auxiliary motor 176. The pilot fluid supply 192 can optionally be provided. Input means 178 can hydraulically control the main control valve 26, for example, or be connected to the pressurizing medium supply assembly by way of the CAN bus 180. Apart from the second control module 20, the first control module 57 is furthermore shown. The variables 70, 102, 100, 116, 130, 74, 40, 56, 52 and/or 124 can in this instance be exchanged by way of the data interface in the form of the CAN bus.

What is claimed is:

1. A hydraulic pressurizing medium supply assembly, comprising:

a hydro machine configured to supply pressurizing medium to at least one hydraulic consumer;

an adjusting mechanism operably connected to the hydro machine;

a hydraulic control block configured to control the at least one hydraulic consumer;

a first control module operably connected to the hydraulic control block and configured to generate at least one actuating signal for controlling the hydraulic control block;

a second control module operably connected to the adjusting mechanism; and a data interface operably connected to the first and the second control modules, wherein the data interface is configured to transfer a further actuating signal from the first control module to the second control module as at least one input variable, wherein the at least one input variable corresponds to a nominal outlet pressure for the hydro machine and/or a nominal delivery volume for the hydro machine, wherein the second control module is configured (i) to generate a valve actuating signal based on the at least one input variable, and (ii) to control the adjusting mechanism based on the valve actuating signal, and wherein the at least one input variable includes at least one hydraulic parameter which predefines and/or limits a dynamic characteristic of the adjusting mechanism.

2. The hydraulic pressurizing medium supply assembly according to claim 1, wherein the at least one hydraulic parameter includes a maximum gradient of one or a plurality of actual variable/variables of the hydraulic pressurizing medium supply assembly.

3. The hydraulic pressurizing medium supply assembly according to claim 1, wherein the at least one hydraulic parameter includes at least one of a maximum delivery-volume adjustment rate of the hydro machine, a maximum pressure gradient for an actual outlet pressure of the hydro machine, a maximum nominal differential pressure for the hydro machine, and a maximum torque gradient.

4. The hydraulic pressurizing medium supply assembly according to claim 3, wherein adapting the maximum nominal differential pressure takes place in such a manner that the maximum nominal differential pressure is included for a normal operation of the pressurizing medium supply assembly, and/or that the maximum nominal differential pressure is included for a precision-control range of at least one of the hydraulic consumers, and/or that a maximum nominal differential pressure is included in a general control range of the at least one hydraulic consumer.

5. The hydraulic pressurizing medium supply assembly according to claim 3, wherein:

various operating modes are able to be set, the various operating modes include at least one pre-set parameter and/or one pre-set actuating signal for the dynamic characteristic of the adjusting mechanism of the hydro machine, and the various operating modes differ from one another in terms of at least one parameter and/or in terms of the at least one actuating signal.

6. The hydraulic pressurizing medium supply assembly according to claim 5, wherein:

adapting a pressure gradient and/or a swivel angle gradient as one of the operating modes takes place as a function of the at least one hydraulic consumer which is being moved, adapting of the maximum pressure gradient as one of the operating modes takes place as a function of a deflection of at least one operating element, adapting the at least one hydraulic parameter as one of the operating modes takes place when a specific operating or actuating situation is detected, and/or adapting a torque limit as one of the operating modes takes place as a function of an operating state of an electric drive.

7. The hydraulic pressurizing medium supply assembly according to claim 1, wherein the data interface is configured to supply a nominal torque as the further actuating signal for the second control module.

8. The hydraulic pressurizing medium supply assembly according to claim 1, wherein the at least one hydraulic parameter is set as a function of at least one of a temperature of the pressurizing medium, an actual rotating speed of the hydro machine, an actual outlet pressure of the hydro machine, and an actual delivery volume of the hydro machine.

9. The hydraulic pressurizing medium supply assembly according to claim 1, further comprising:

at least one filter for the at least one input variable to the second control module, wherein the at least one filter provides a PT1 transfer function.

10. The hydraulic pressuring medium supply assembly according to claim 1, wherein a mobile work machine includes the hydraulic pressurizing medium supply assembly.

* * * * *